US010859332B2

(12) United States Patent
McMillan

(10) Patent No.: US 10,859,332 B2
(45) Date of Patent: Dec. 8, 2020

(54) FIREARM RECEIVER WITH ADJUSTABLE POSITIONING ASSEMBLY

(71) Applicant: James Eric McMillan, Macon, GA (US)

(72) Inventor: James Eric McMillan, Macon, GA (US)

(73) Assignee: U.S. Arms Company LLC, Macon, GA (US)

( * ) Notice: Subject to any disclaimer, the term of this patent is extended or adjusted under 35 U.S.C. 154(b) by 0 days.

(21) Appl. No.: 16/831,167

(22) Filed: Mar. 26, 2020

(65) Prior Publication Data

US 2020/0309475 A1 Oct. 1, 2020

Related U.S. Application Data

(60) Provisional application No. 62/824,455, filed on Mar. 27, 2019.

(51) Int. Cl.
*F41A 3/66* (2006.01)

(52) U.S. Cl.
CPC ..... *F41A 3/66* (2013.01)

(58) Field of Classification Search
CPC ..... F41A 11/04; F41A 3/66
USPC ..... 42/75.03
See application file for complete search history.

(56) References Cited

U.S. PATENT DOCUMENTS 9,188,399 B1 * 11/2015 Findlay ..... F41A 11/00
9,568,261 B1 * 2/2017 Hall ..... F41A 3/66
2013/0055610 A1 * 3/2013 Watkins ..... F41A 11/04 42/16
2017/0299292 A1 * 10/2017 Daley, Jr. ..... F41A 3/66

* cited by examiner

*Primary Examiner* — Reginald S Tillman, Jr.
(74) *Attorney, Agent, or Firm* — Jason T. Daniel, Esq.; Daniel Law Offices, P.A.

(57) ABSTRACT

A firearm receiver includes a lower receiver body having a pair of takedown pin openings that are positioned along each side, and a bolt channel that extends diagonally from the back end of the receiver body to the inside of the receiver body. A takedown pin assembly is positioned within the receiver body and is in communication with the bolt channel. The takedown pin assembly including a takedown pin that is selectively positioned within the pair of takedown pin openings. The takedown pin assembly including a cam-pin and securement bolt that engage a lock tensioner that is connected to the takedown pin. The cam-pin transitioning between an engaged position and a disengaged position. In the engaged position, the cam-pin imparts a downward force onto the lock tensioner, takedown pin and an upper receiver that is connected to the takedown pin.

15 Claims, 9 Drawing Sheets

FIREARM RECEIVER WITH ADJUSTABLE POSITIONING ASSEMBLY

CROSS-REFERENCE TO RELATED APPLICATIONS

This application claims the benefit of U.S. Application Ser. No. 62/824,455 filed on Mar. 27, 2019, the contents of which are incorporated herein by reference.

TECHNICAL FIELD

The present invention relates generally to firearms, and more particularly to a firearm receiver and assembly for securing upper and lower receiver portions of a firearm together to reduce movement of the same.

BACKGROUND

The statements in this section merely provide background information related to the present disclosure and may not constitute prior art.

As shown at background FIGS. 1A and 1B, semi-automatic rifles 1 include a separate upper receiver 2 and lower receiver 3 that are secured together via a pivot pin 4 along the front ends, and a takedown pin 5 that is removably positioned through apertures 6*a* and 6*b* along the back ends of the receivers. With regard to popular rifle types, such as the illustrated AR-15, for example, many different manufacturers produce components which are designed to be interconnected with other components to form a fully assembled firearm. In this regard, it is possible to assemble the firearm using upper and lower receivers that are manufactured by the same or different companies.

Depending on the specific tolerances of the upper and lower receiver halves, a resulting gap 7 is formed along the mating surfaces, and it is not uncommon for there to be a certain amount of independent movement between the receiver halves when assembled. This movement (often referred to as "slop) is undesirable, as it can misalign the bolt and cartridge, thereby reducing the reliability of the firearm and/or can greatly diminish the accuracy of the rifle because the barrel and projectile may move in conjunction with the upper receiver in response to recoil forces generated during rifle firing.

Accordingly, it would be beneficial to provide a firearm receiver with an adjustable positioning assembly that can reduce or eliminate undesirable movement between upper and lower receiver halves.

SUMMARY OF THE INVENTION

The present invention is directed to a firearm receiver with an adjustable positioning assembly. One embodiment of the present invention can include a lower receiver body for communicating with an upper firearm receiver and other firearm components. The lower receiver body can include a pair of takedown pin openings that are positioned along each side of the receiver body, and a bolt channel that extends diagonally from the back end of the receiver body to the inside of the receiver body.

A takedown pin assembly can be positioned within the receiver body and can be in communication with the bolt channel. The takedown pin assembly including a takedown pin that is selectively positioned within the pair of takedown pin openings. In one embodiment, the takedown pin assembly can include functionality for transitioning between an engaged position and a disengaged position. In the engaged position, the takedown pin assembly can impart a downward force onto an upper receiver that is connected to the takedown pin.

In one embodiment, the pin assembly can include a lock tensioner that is in communication with the takedown pin and a securement bolt that is located within the bolt channel.

In one embodiment, the pin assembly can include a cam pin that is positioned within a cam channel. The cam pin can be in communication with the securement bolt and selectively impart the downward force onto the block tensioner and securement bolt upon receiving a rotational force.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
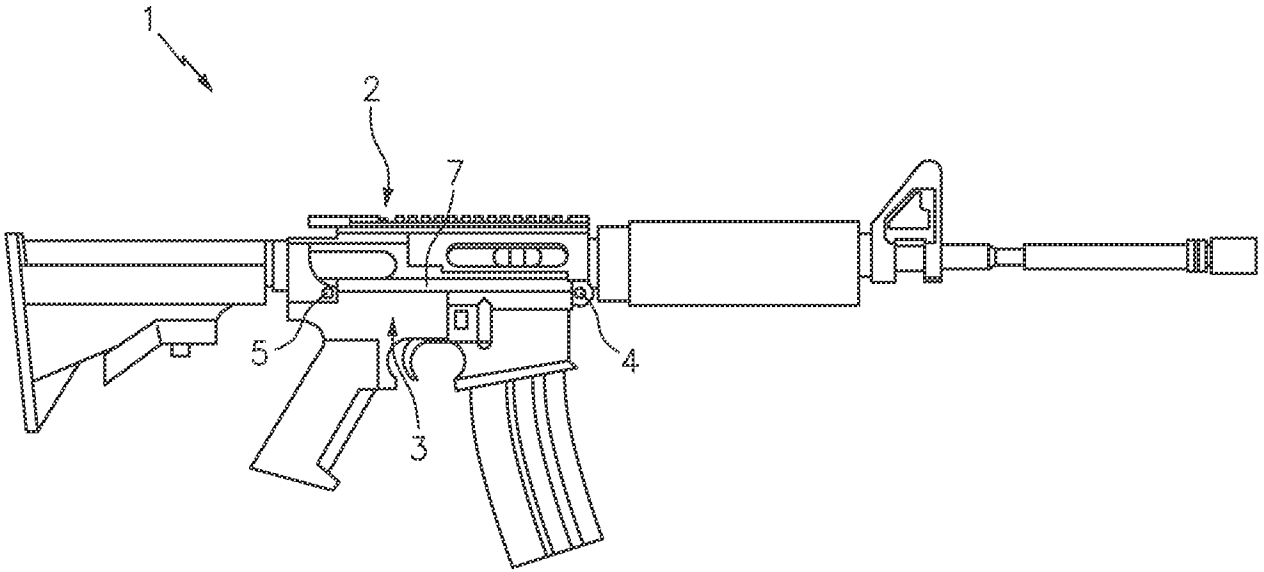
FIG. 1A (BACKGROUND ART)
FIG. 1A is a side view of a firearm in accordance with background art.
Figure 1B:
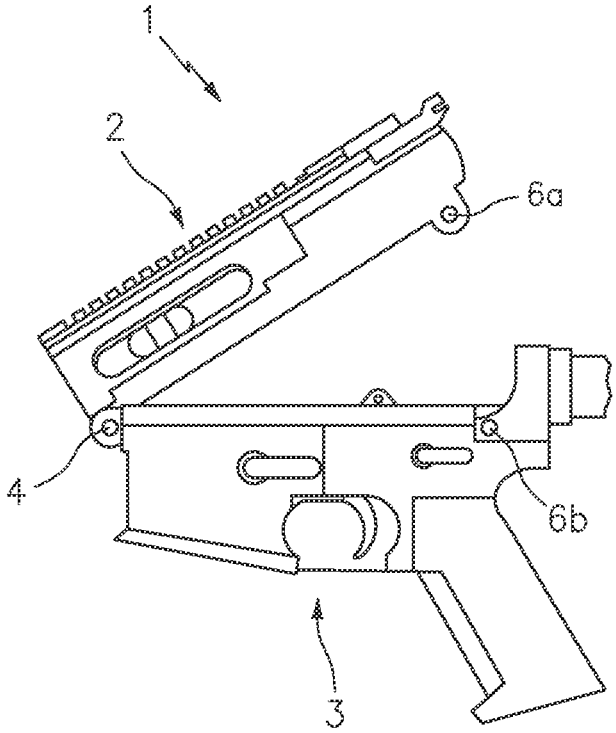
FIG. 1B (BACKGROUND ART)
FIG. 1B is a perspective view of a firearm in accordance with background art.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

One embodiment of a firearm receiver with an adjustable positioning assembly 10 is described below with reference to the drawings. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 6.

As shown and described below, one embodiment of the firearm receiver with adjustable positioning assembly 10 can include a lower receiver body 20 having an adjustable takedown pin assembly 30 positioned therein.

Figure 2A:
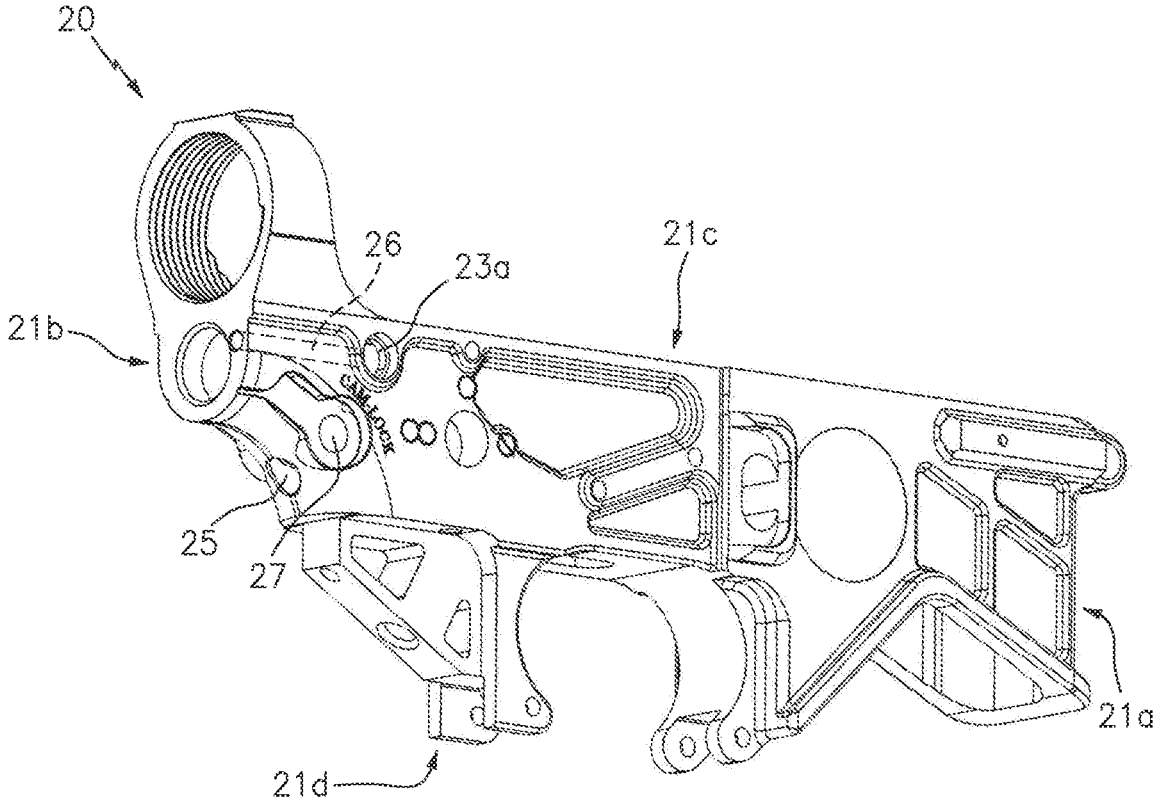
FIG. 2A is a perspective view of a receiver body of the firearm receiver with an adjustable positioning assembly, in accordance with one embodiment of the invention.
Figure 2B:
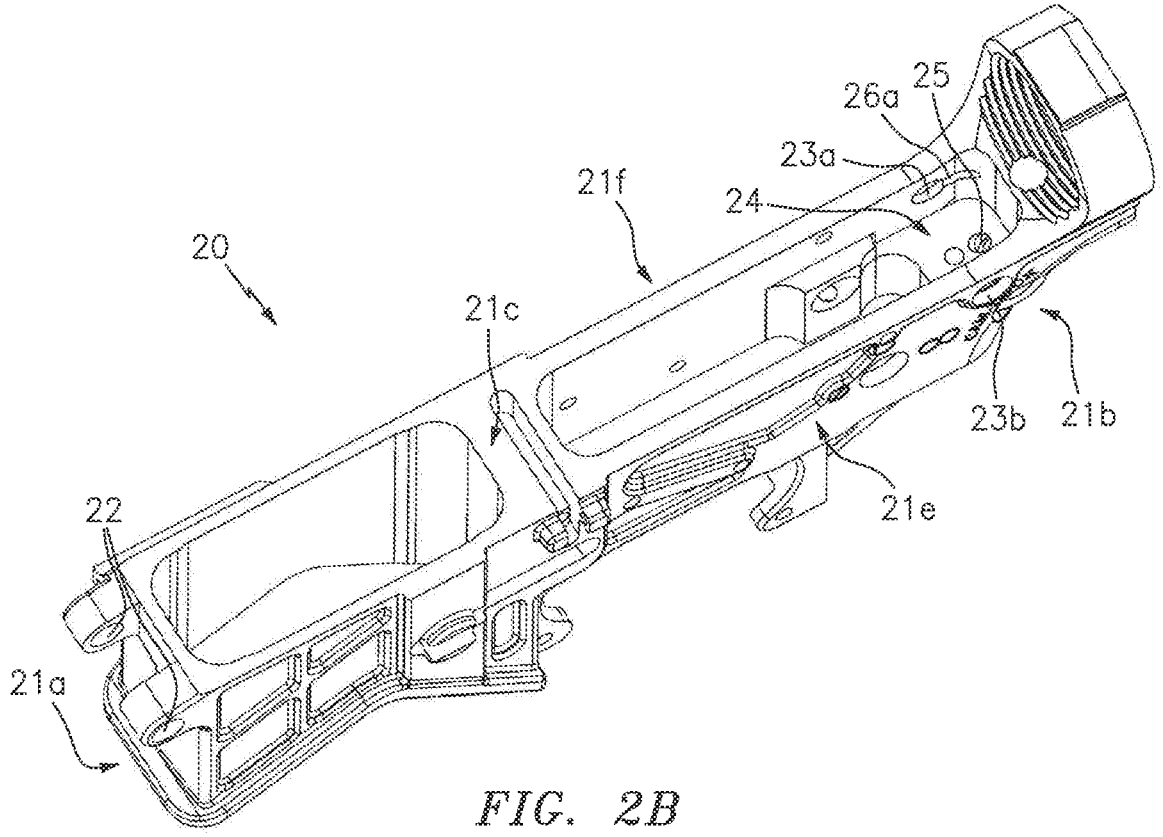
FIG. 2B is a top view of a receiver body of the firearm receiver with an adjustable positioning assembly, in accordance with one embodiment of the invention.

FIGS. 2A and 2B illustrate one embodiment of a firearm receiver 20 for use with the below described assembly 30. As shown, the receiver can include a front end 21*a*, a back end 21*b*, a bottom end 21*c*, a top end 21*d* and a pair of sides 21*e* and 21*f*. Pivot pin apertures 22 can be positioned along the front end of the receiver body for receiving a pivot pin such as the pivot pin 4 described above, for example.

In the preferred embodiment, the receiver body 20 can be constructed for use as a lower receiver of an AR-15 firearm and can include functionality for engaging any number of associated rifle components such as a handgrip, shoulder stock, trigger assembly, and an upper receiver, for example. Each of these components and their operability with a lower receiver are well known in the art.

Although described and illustrated with regard to an AR-15 rifle, those of skill in the art will recognize that the same principals can be applied to any type of firearm having an upper receiver and lower receiver components without undue experimentation. Therefore, the inventive concepts are not to be construed as limiting to only an AR-15 rifle.

In either instance, the receiver body 20 can also include a plurality of apertures for receiving the below described adjustable takedown pin assembly 30. As such, the receiver body 20 can include takedown pin openings 23*a* and 23*b* along both sides of the receiver body. In the preferred embodiment, the takedown pin openings can include an elongated/oval shape so as to permit slight movement of the below described takedown pin upon engagement of the assembly 30.

An angled bolt channel 25 can extend diagonally from the lower back surface of the receiver body, and can terminate at the receiver block section 24 positioned between the receiver body sides 21*e* and 21*f*. A rear channel 26 can extend longitudinally from the back end of the receiver body 21*b* along the side wall of the receiver, and can terminate into the pin opening 23*a*. Additionally, a cam channel 27 can be positioned below and parallel to the openings 23*a* and 23*b*. The cam channel can extend through the angled bolt channel 25 in order to allow components positioned within both channels to engage in the manner described below.

In the preferred embodiment, the bolt channel 25 can be positioned at an angle of between 30 degrees and 70 degrees relative to the receiver body 20, so as to allow the below described assembly 30 to pull the takedown pin 32 and a connected upper receiver down and toward the back of the lower receiver at a corresponding angle. Such a feature being important to ensure continuous and proper alignment of the rifle components.

Figure 3A:
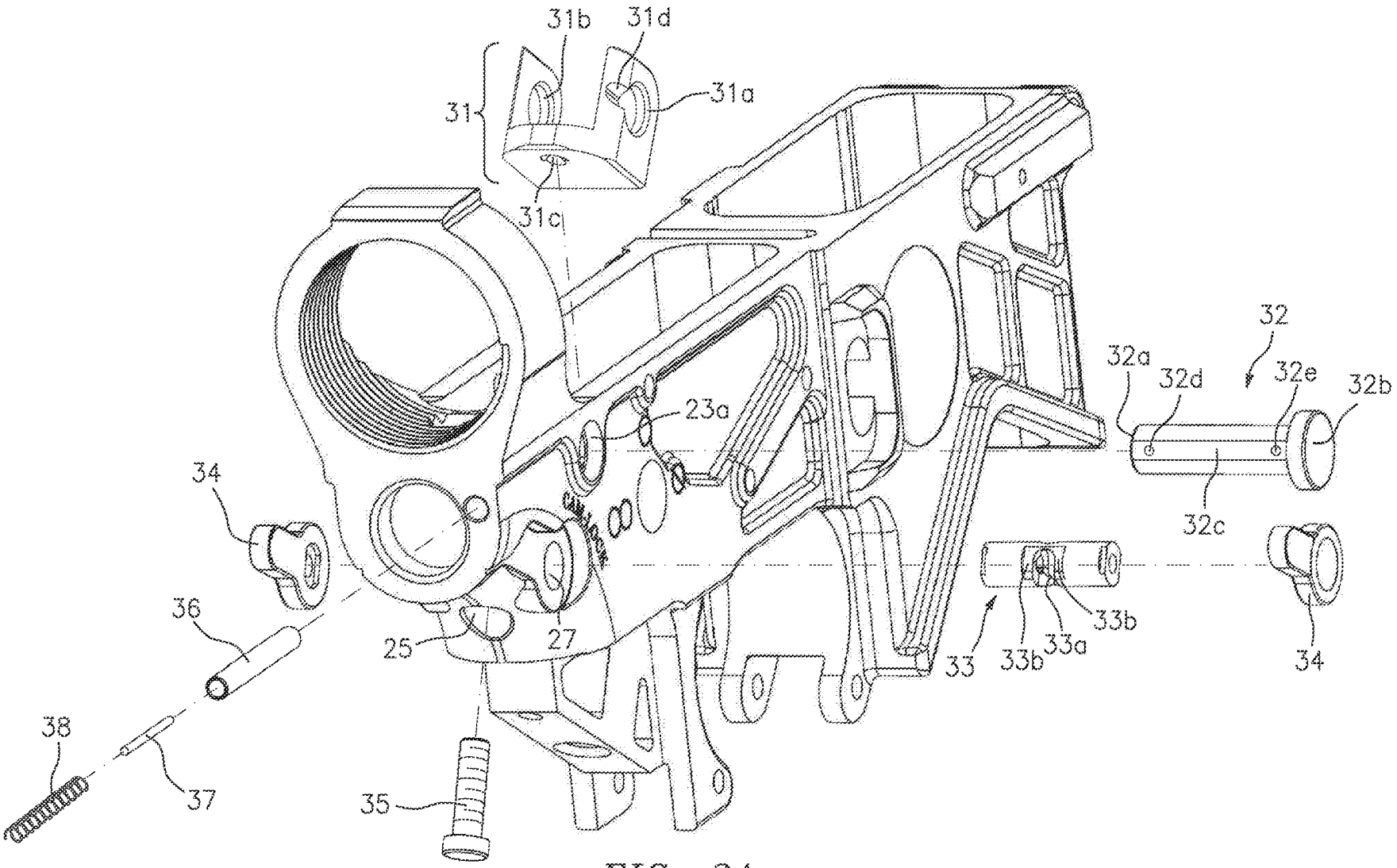
FIG. 3A is an exploded parts view of the firearm receiver with an adjustable positioning assembly, in accordance with one embodiment of the invention.
Figure 3B:
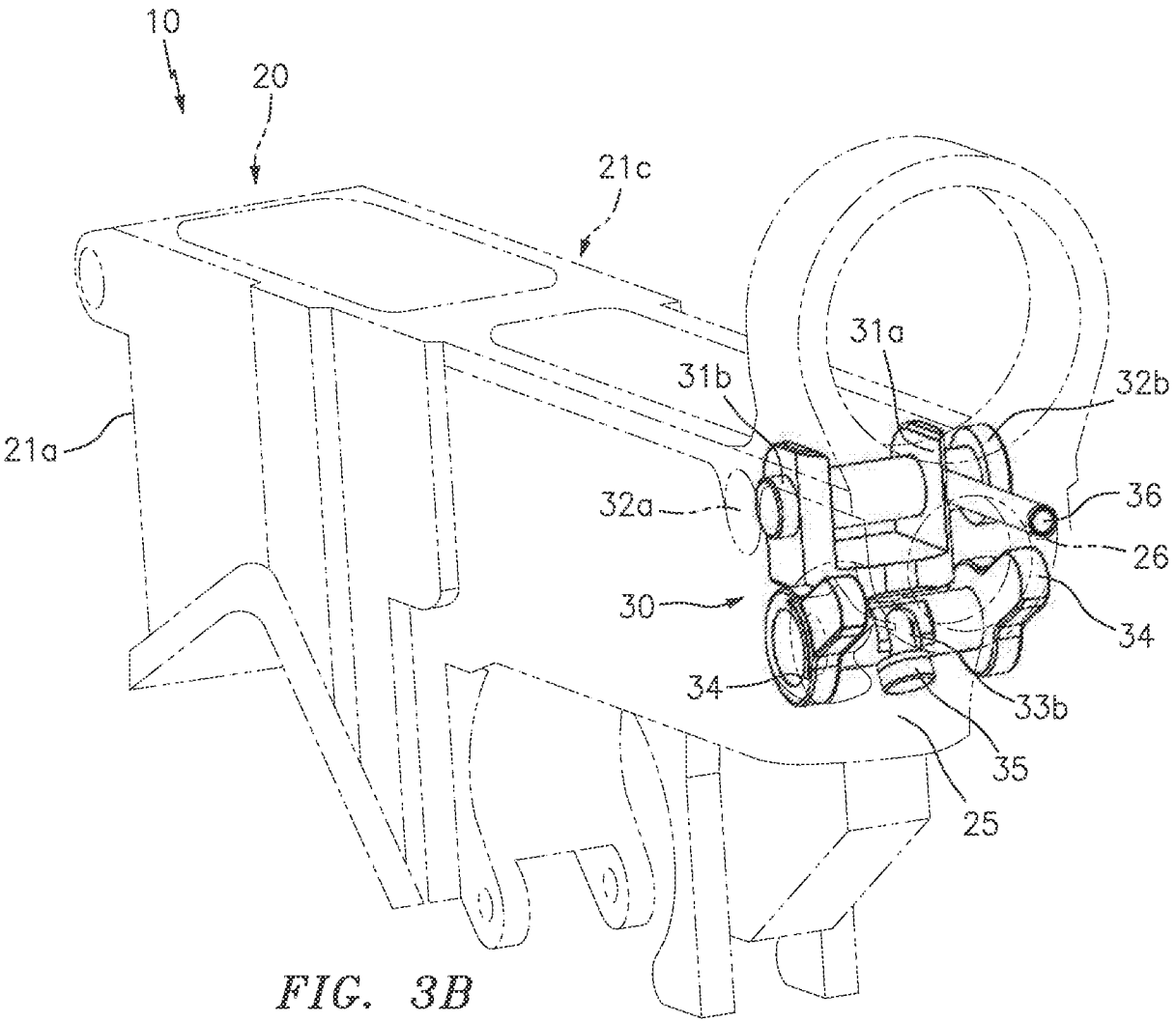
FIG. 3B is a perspective view of the firearm receiver with an adjustable positioning assembly, in accordance with one embodiment of the invention.
Figure 3C:
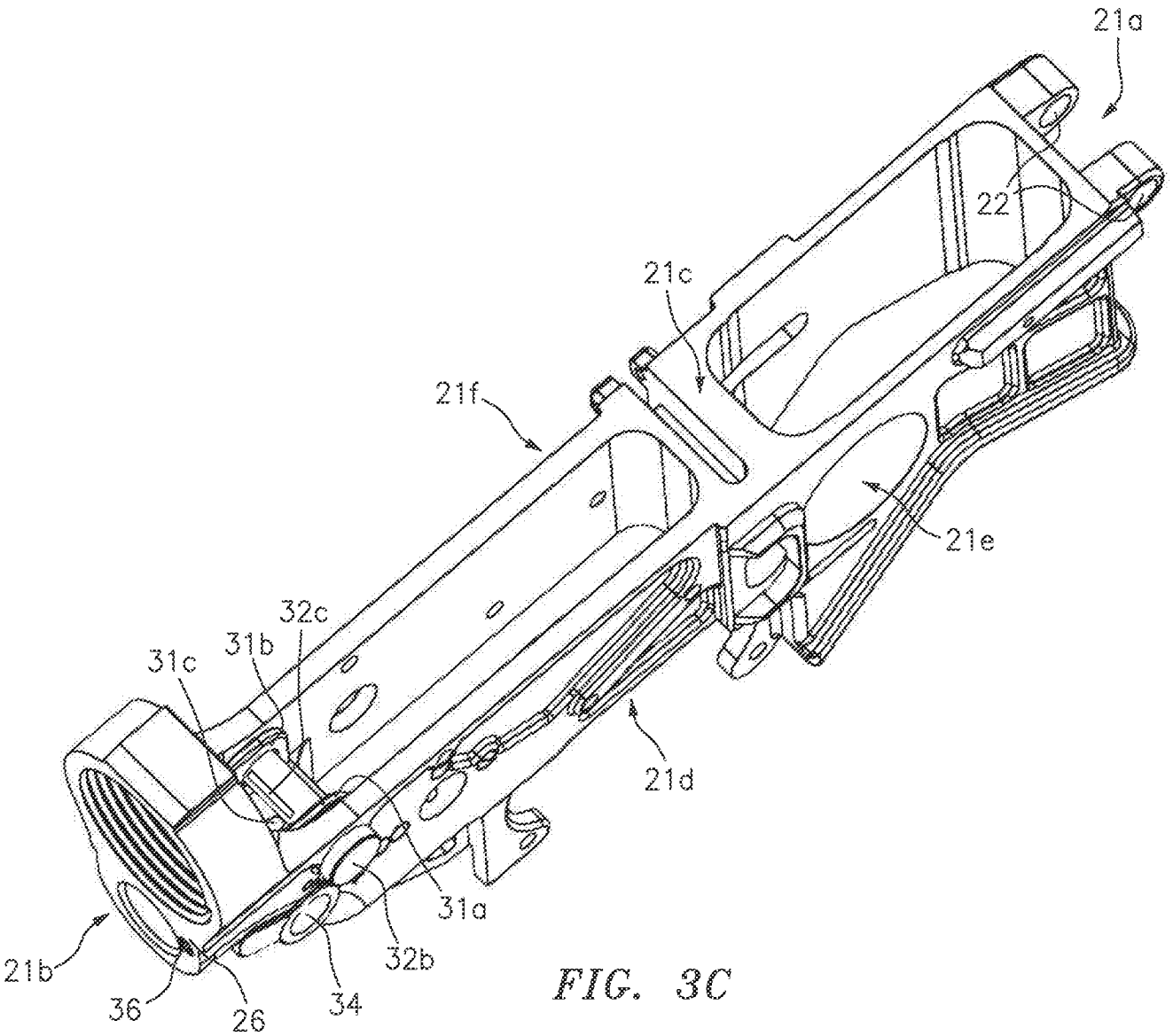
FIG. 3C is a top view of the firearm receiver with an adjustable positioning assembly, in accordance with one embodiment of the invention.

FIGS. 3A-3C illustrate one embodiment of an adjustable takedown pin assembly 30 and the integration of the assembly within the receiver body 20. As shown, the assembly 30 can include the illustrated lock block tensioner 31, takedown pin 32, cam-pin 33, adjustment arms 34, securement bolt 35, sleeve 36, takedown detent pin 37 and detent spring 38.

In one embodiment, the lock block tensioner 31 can include a generally U-shaped body having parallel openings 31*a* and 31*b* having a shape and size that are complementary to the size and location of the takedown pin openings 23*a* and 23*b* located along the inside walls of the receiver body. A threaded aperture 31*c* can be positioned along the bottom end of the block body for receiving the securement bolt 35, and a groove 31*d* can be positioned along the side of the block body extending transversely into opening 31*a*. The groove 31*d* functioning to provide clearance for, and receive the sleeve 36 and detent pin 37.

As shown, the lock block tensioner 31 can be positioned along the top surface of the receiver block 24 so that the threaded aperture 31*c* is aligned with the angled bolt channel 25 in order to receive the securement bolt 35. When so positioned, openings 31*a* and 31*b* are aligned linearly with pin openings 23*a* and 23*b*, respectively, and function to receive the takedown pin 32 therethrough.

One embodiment of the takedown pin 32 can include an elongated member having a narrow first end 32*a*, a broad second end 32*b* and an elongated indented channel 32*c* extending therebetween. In the preferred embodiment, two dimples 32*d* and 32*e* can be positioned along both ends of the groove.

In one embodiment, an elongated hollow sleeve 36 can be positioned within the rear channel 26 of the receiver, and can permit movement of a detent pin 37 and spring 38 positioned within the sleeve. When so positioned, the distal end of the sleeve can reside within the grooves 31*d* and 26*a*, respectively, so as to be aligned perpendicularly with the channel 32*c* of the takedown pin 32. When the weapon is assembled with a shoulder stock (not illustrated) the spring 38 can impart a constant pressure onto the detent pin 37 so as to cause the detent pin to engage the channel and dimples of the takedown pin 32.

More specifically, the detent pin 37 allows perpendicular movement of the pin (relative to the detent pin) and can selectively engage dimples 32*d* and 32*e* to maintain the pin in the open position wherein the pin is not positioned within both openings 31*a* and 31*b*, and the closed position where the pin is positioned within both openings 31*a* and 31*b*. In either instance, the spring loaded detent pin engages the takedown pin so as to prevent inadvertent removal of pin from the receiver.

The cam-pin 33 can include an elongated shaft having a centrally located aperture 33*a* through which the securement bolt 35 is positioned. Recessed channel area 33*b* is located along both sides of the aperture 33*a* perpendicular to the major axis of the pin body, and is milled to permit rotation of the pin shaft around the bolt. This rotation is preferably equal to 90 degrees of rotation, but other degrees of rotation are also contemplated.

In one embodiment, a pair of adjustment arms 34 can be secured along both sides of the cam-pin, and can be selectively engaged by a user's thumb to effect rotation of the cam-pin body. Of course, the assembly is not limited to the use of thumb levers, as any number of other mechanisms capable of allowing a user to selectively rotate the cam-pin are also contemplated. For example, the adjustment arms can include, comprise or consist of indentations, for example, that can be engaged by a tool such as a screwdriver or Allen wrench, among other mechanisms, for example.

The securement bolt 35 can be positioned within the first end of the angled bolt channel 25 along the bottom rear portion of the receiver body. The bolt can pass through the central cam aperture 33*a* until the bolt head is resting against the cam-pin. At this time, the distal end of the bolt can pass through the other end of the channel 25 and can engage the threaded apertures 31*c* on the bottom of the block tensioner. When so positioned, the bolt can be tightened to impart an initial force onto the block tensioner.

Figure 4:
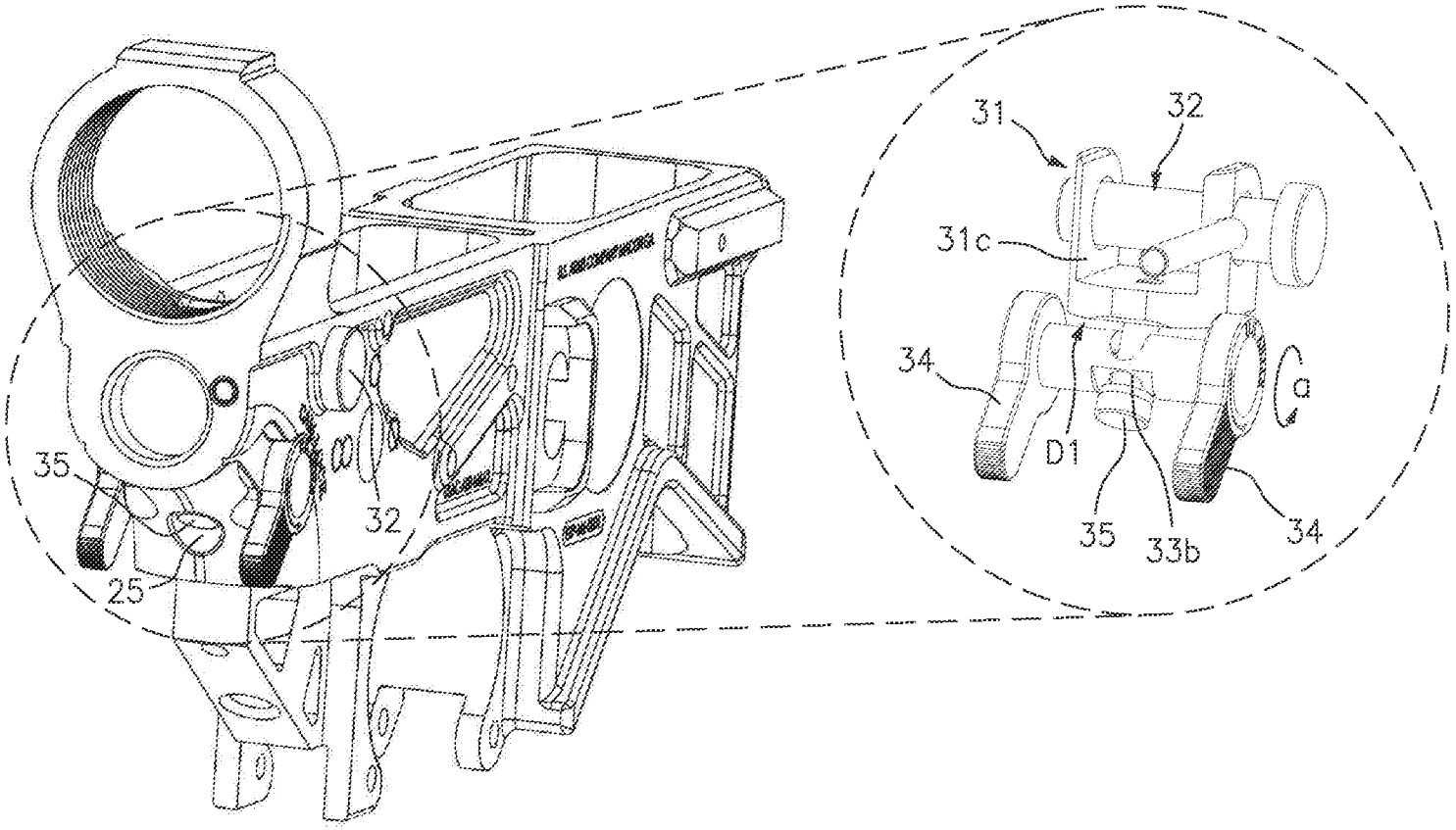
FIG. 4 is a partial cutout view of the firearm receiver with an adjustable positioning assembly, in the disengaged position, in accordance with one embodiment of the invention.
Figure 5:
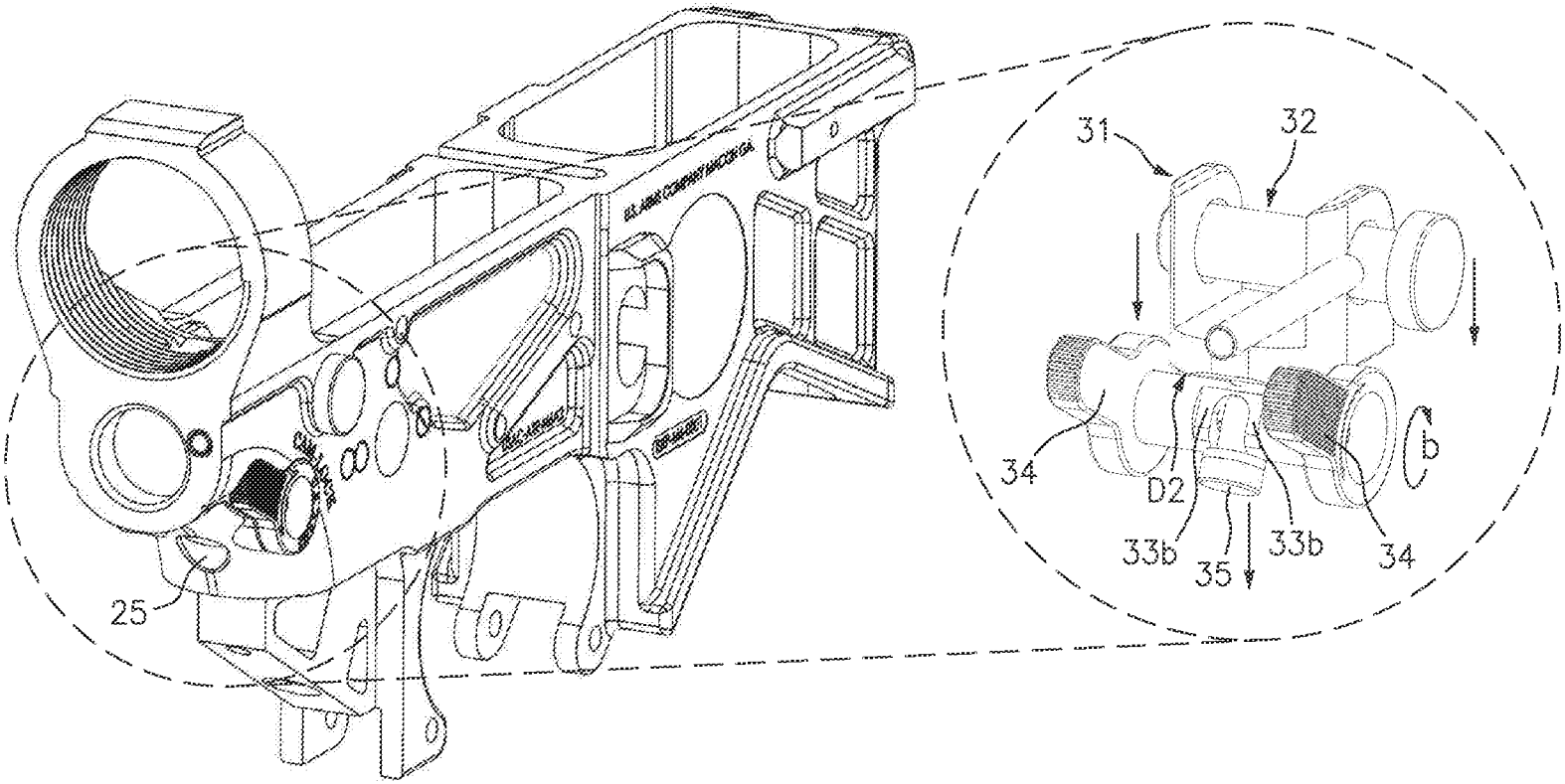
FIG. 5 is a partial cutout view of the firearm receiver with an adjustable positioning assembly, in the engaged position, in accordance with one embodiment of the invention.

FIGS. 4 and 5 illustrate one embodiment of the system 10 in the disengaged position and the engaged position, respectively.

As shown at FIG. 4, movement of the adjustment arms 34 in a first direction (arrow a) causes the cam-pin 33 to rotate about the securement bolt 35 until the head of the bolt is located within or along the recessed channel area 33*b*. When so positioned, the cam-pin 33 and the block tensioner 31 are separated by a first distance D1, and the cam-pin does not impart a pulling force onto the bolt 35. Likewise, the block tensioner does not impart an additional pulling force onto the takedown pin 32.

As such, this is the preferred position of the adjustable takedown pin assembly 30 when sliding the takedown pin between the open and closed position, and when actively securing or disengaging an upper receiver to the takedown pin 32.

As shown at FIG. 5, movement of the adjustment arms 34 in a second direction (arrow b) causes the cam-pin 33 to rotate about the securement bolt 35 until the head of the bolt is not located within the recessed channel area 33*b*. In this regard, the cam-pin 33 imparts a pulling force onto the securement bolt 35 which is transmitted directly to the block tensioner 31 and the takedown pin 32. Therefore, when in this position, cam-pin 33 and the block tensioner 31 are separated by a second distance D2 that is less than the first distance D1.

In one embodiment, the difference between D1 and D2 can be ten-thousandths of an inch, which is equal to a pulling force of about 5 pounds. Such amounts being suitable to pull the upper receiver down to the lower receiver, thereby removing the gap between the mating surfaces and eliminating undesirable movement between the lower receiver and an upper receiver that is engaged to the takedown pin assembly 30. As such, this is the preferred position of the adjustable assembly 30 when an upper receiver is secured by the takedown pin and the firearm is in active operation. Of course, other embodiments are contemplated wherein the pulling force is greater or less than the preferred 5 pounds.

Figure 6:
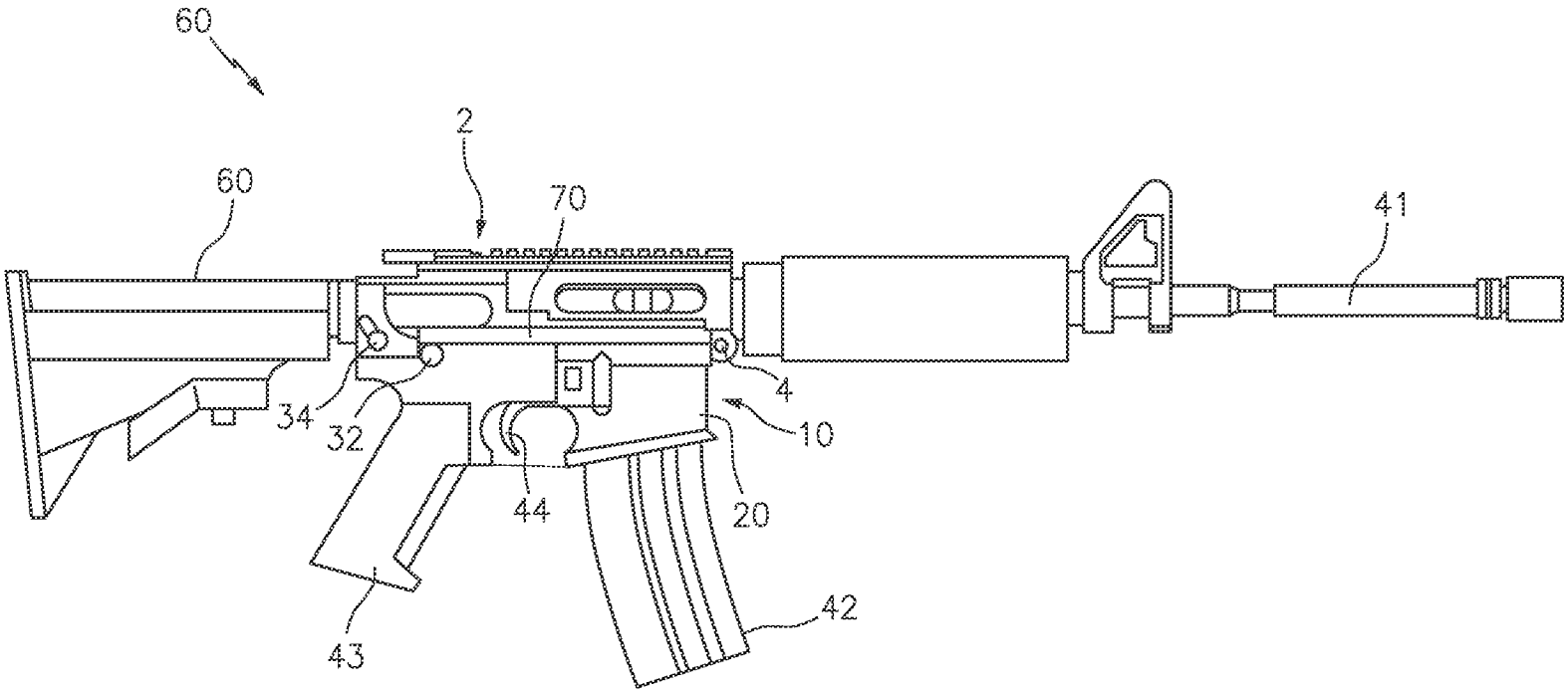
FIG. 6 is a side view of a firearm having a receiver with an adjustable positioning assembly, in accordance with one embodiment of the invention.

FIG. 6 illustrates one embodiment of a firearm 60 having the above described firearm receiver with adjustable positioning assembly 10. As shown, the firearm can include an upper receiver 2 that is secured to the lower receiver body 20 via a pivot pin 4, and the takedown pin 32. The firearm can also include the illustrated barrel 41, magazine 42, handgrip 43, trigger assembly 44 and shoulder stock 45, for example. As shown, when the adjustment arm 34 is in the active position, the gap 70 between the upper and lower receiver bodies is reduced such that the mating surfaces of the upper receiver and lower receiver are in direct contact.

Accordingly, the above described firearm receiver with adjustable positioning assembly 10 advantageously functions to impart a downward force the upper receiver 3 that is connected to the takedown pin 32. Moreover, owing to the angle of the securement bolt 35 within the bolt channel 25, the device also pulls the upper receiver backward (e.g., toward the back end 21*b*) of the lower receiver body. Such forces functioning to preload the pivot pin 4 and load the takedown pin 32 in a manner that aligns the internally located rifle components such as the buffer tube and bolt, for example, in a manner not possible with other devices.

Moreover, the unique pulling force of the inventive assembly maintains proper alignment of the rifle components for as long as the assembly is in the active operating state.

Although described above as including both a receiver body and adjustable positioning assembly, the inventive concepts are not so limiting. To this end, other embodiments are contemplated wherein the adjustable takedown pin assembly 30 can be installed in a different receiver body that has been augmented to include the above described channels and apertures. Therefore, both the illustrated receiver body 20 itself and the assembly 30 may be provided and/or used separately from the other.

As described herein, one or more elements of the firearm receiver with adjustable positioning assembly 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A firearm lower receiver, comprising:

an elongated body having a top end, a bottom end, a front end, a back end, a pair of side surfaces, and a block section positioned between the pair of side surfaces;

a pair of takedown pin openings that are positioned along each of the pair of side surfaces;

a bolt channel that extends diagonally from the back end of the body through the block section; and a takedown pin assembly that is in communication with the bolt channel, and including a takedown pin that is selectively positioned within the pair of takedown pin openings, wherein the takedown pin assembly includes functionality for transitioning between an engaged position and a disengaged position.

2. The firearm lower receiver of claim 1, wherein in the engaged position, the takedown pin assembly imparts a pulling force onto the takedown pin.

3. The firearm lower receiver of claim 1, wherein the takedown pin assembly further comprises:

a generally U-shaped block tensioner having a bottom surface and a pair of arms; and a first opening that is positioned along one of the pair of arms; and a second opening that is positioned along the other of the pair of arms.

4. The firearm lower receiver of claim 3, wherein the block tensioner is selectively positioned along the block section, such that the first opening and the second opening are each aligned with one of the pair of takedown pin openings.

5. The firearm lower receiver of claim 3, further comprising:

a securement bolt that is selectively positioned within the bolt channel.

6. The firearm lower receiver of claim 5, wherein the securement bolt is connected to the bottom end of the block tensioner.

7. The firearm lower receiver of claim 6, further comprising:

a cam channel that is positioned along the receiver body at a location parallel to the pair of takedown pin openings.

8. The firearm lower receiver of claim 7, wherein the cam channel bisects the bolt channel.

9. The firearm lower receiver of claim 8, further comprising:

a cam-pin having an elongated shaft that is positioned within the cam channel.

10. The firearm lower receiver of claim 9, wherein the cam-pin selectively engages the securement bolt positioned within the bolt channel.

11. The firearm lower receiver of claim 9, further comprising:

an aperture that is located along a middle portion of the elongated shaft of the cam pin.

12. The firearm lower receiver of claim 11, further comprising:

a recession that is positioned adjacent to the aperture on the cam pin.

13. The firearm lower receiver of claim 12, wherein the securement bolt is positioned through the aperture on the cam pin, and wherein the securement bolt selectively engages the recession.

14. A firearm, comprising:

a lower receiver that includes an elongated body having a top end, a bottom end, a front end, a back end, a pair of side surfaces, and a block section positioned between the pair of side surfaces;

a pair of takedown pin openings that are positioned along each of the pair of side surfaces;

a bolt channel that extends diagonally from the back end of the body through the block section;

a takedown pin assembly that is in communication with the bolt channel, and including a takedown pin that is selectively positioned within the pair of takedown pin openings; and an upper receiver that is in communication with the takedown pin;

wherein the takedown pin assembly includes functionality for transitioning between an engaged position and a disengaged position.

15. The firearm of claim 14, wherein in the engaged position, the takedown pin assembly imparts a pulling force onto the upper receiver.

* * * * *